United States Patent [19]

Drader

[11] 4,163,495

[45] Aug. 7, 1979

[54] PLASTIC BREAD CARRIER HAVING FOLDING END WALLS

[76] Inventor: Clarence H. Drader, R.R. #2, Sherwood Park, Alberta, Canada

[21] Appl. No.: 835,217

[22] Filed: Sep. 21, 1977

[30] Foreign Application Priority Data

Sep. 25, 1976 [GB] United Kingdom ..... 39928/76

[51] Int. Cl.[2] ..... B65D 21/02; B65D 7/26; A47G 23/06

[52] U.S. Cl. ..... 206/506; 211/126; 220/6; 224/48 R

[58] Field of Search ..... 220/4 F, 6, 7; 206/506; 224/48 R, 48 D; 211/126

[56] References Cited

U.S. PATENT DOCUMENTS

| | | | |
|---|---|---|---|
| 2,994,463 | 8/1961 | Drader | 206/506 |
| 3,054,501 | 9/1962 | Maynard | 220/6 |
| 3,204,778 | 9/1965 | Nawman | 206/506 |
| 3,648,909 | 3/1972 | Wiscarver | 224/48 R |
| 3,782,579 | 1/1974 | Zarges | 220/4 F |
| 3,941,271 | 2/1976 | Zarges | 220/6 |

FOREIGN PATENT DOCUMENTS

| | | | |
|---|---|---|---|
| 2268700 | 4/1974 | France | 220/7 |

*Primary Examiner*—George E. Lowrance
*Attorney, Agent, or Firm*—Ernest Peter Johnson

[57] ABSTRACT

The carrier comprises a tray having a floor and rails extending around its perimeter. A pair of end walls are provided at the ends of the tray. Each end wall is pivotally connected to the tray so that it can be rotated from a horizontal position overlying the floor to a vertical position above the end rails. The pivot connection also permits limited vertical movement so that the walls can be pushed down to engage the rails. The lower portion of each end wall is formed of inner and outer spaced-apart legs which define a first groove extending the length of the wall. The rail penetrates into this groove when the wall is lowered onto the rail so that the wall and rail are secured together. There is also a row of abutments extending along the base of each end rail and spaced inwardly therefrom to form a second groove which is part of the tray. The inner leg of each end wall seats in one of these grooves when the wall is lowered. The legs and abutments cooperate to prevent each wall being rotated inwardly and outwardly when it is in the lowered position. Releasable means are provided for restraining upward movement of the end walls relative to the tray when the end walls are in the downwardly shifted position. The advantages: Because the means securing together the end walls and tray extend across the width of the tray, forces acting against the end walls are resisted by the tray as a whole. This has made it possible to make the carrier of plastic as forces are not concentrated at a small segment of the carrier. Also the end walls are easily moved between stacking and folded positions.

2 Claims, 9 Drawing Figures

PLASTIC BREAD CARRIER HAVING FOLDING END WALLS

BACKGROUND OF THE INVENTION

The present invention relates to a folding and stacking carrier for loaves of bread and the like. The carrier is tray-like in form and has end walls which can be folded down, for space saving, and which can be erected to support another carrier above it so that the carriers are in spaced, stacked relationship.

Bakeries commonly use tray-like carriers to carry and stack groups of bread loaves. In its simplest form, the carrier comprises a rectangular grid having upstanding walls extending along the side edges thereof. The carrier is usually of solid one-piece construction-that is because it must be particularly rugged, due to the rough handling to which it is subjected, and because it must remain rigid and stable when forming part of a loaded stack that is being moved about.

Some years ago I developed a steel carrier (shown in U.S. Pat. No. 2,994,463) having a rectangular grid floor, a rigid rail or wall extending around the perimeter of the floor and connected thereto, and a pair of opposed collapsible end walls which could be rotated from a collapsed horizontal position, internal of the floor perimeter, to an upstanding position atop the adjacent rails. Locking devices were provided at the ends of the walls to lock them to the rails, so that they formed rigid upward extensions thereof.

These units owed part of their success to the fact that the end walls and locking devices were formed of spring steel, so that the needed rigidity, strength and stability could be obtained.

The steel carriers have enjoyed considerable commercial success. However, their manufacturing cost is now becoming relatively high and it has become desirable to embody the desirable feature of the folding walls in a carrier manufactured of rigid plastic, such as polyethylene.

When prototypes were built of plastic, it was found that corner locking elements were a problem, as the plastic was not strong enough or rigid enough to be suitable. The concentration of forces was too much for the materials used. Significant problems were also encountered in devising a unit which had walls of sufficient stability and rigidity.

SUMMARY OF THE INVENTION

It was therefore the object of this invention to develop a plastic carrier having folding end walls which securely interconnect with the rails and give a sturdy, rigid unit which can successfully be used in a stack.

It was a preferred object to provide such a carrier having end walls which were capable of erection by machine, for use in an automated facility.

In accordance with the invention, a plastic carrier is provided comprising a tray having a floor section and end rails. A pair of end walls are pivotally connected to the tray so as to be rotatable from a horizontal position overlying the floor section to a vertical position above the rails. The pivot connection also permits limited vertical movement of the end walls, so that, once vertically positioned, they may be lowered onto the rails to engage means which restrain each end wall from rotation outwardly or inwardly. Releasable means are also provided to secure the walls onto the rails when they have been lowered—such means controlling vertical freedom may be manually released so that the walls may be lifted clear of the rails to disengage the restraining means which control rotational freedom. One set of restraining means is part of the tray and is operative to restrain the walls from rotating further outwardly substantially beyond the vertical; another set of restraining means is part of the walls and is operative to restrain the walls from rotating back inwardly toward the floor section. The restraining means preferably extend or are disposed across the width of the tray so that forces acting transversely to the walls are resisted by the tray as a whole—that is, the load is distributed across the width of the tray.

Broadly stated, the present invention provides a plastic carrier for bread and the like comprising: a rectangular tray having a floor section and a pair of end rails upstanding from the floor section; a pair of end walls connected with the tray for rotation, between a generally horizontal position overlying the floor section and a generally vertical position wherein they are disposed above the end rails, and for limited vertical movement, whereby the end walls may be shifted downward when generally vertical onto the end rails, to form upwardly projecting extensions of said end rails, or upward off the end rails; means, connected with the tray, for engaging said end walls when shifted downward to restrain them from rotating further outward substantially beyond vertical; means, connected with each end wall, for engaging the adjacent end rail when the end wall is shifted downward to restrain the end wall from rotating back inwardly toward the floor section; and releasable means for restraining upward movement of the end walls relative to the tray when said end walls are in the downwardly shifted position.

PREFERRED EMBODIMENT OF THE INVENTION

Figure 1:
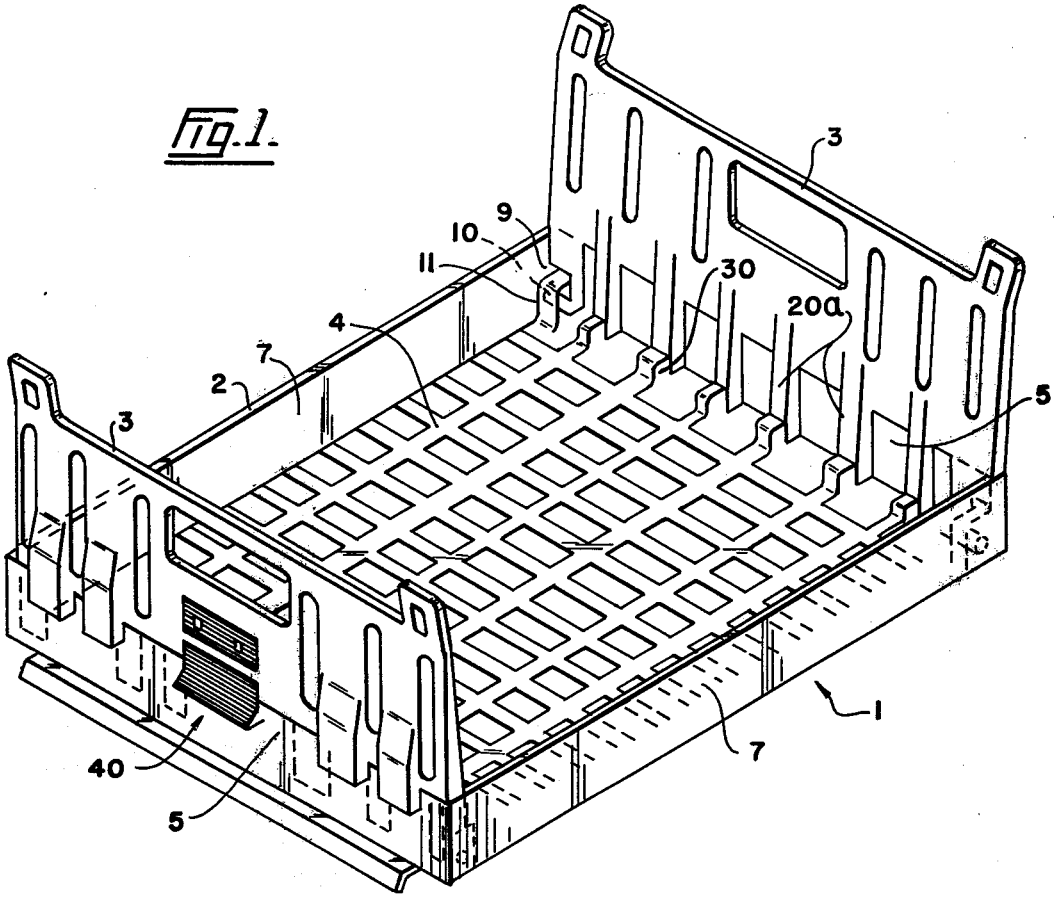
FIG. 1 is a perspective view of a plastic carrier showing the end walls of the carrier secured in a generally vertical position to form upwardly projecting extensions of opposed end rails.
Figure 2:
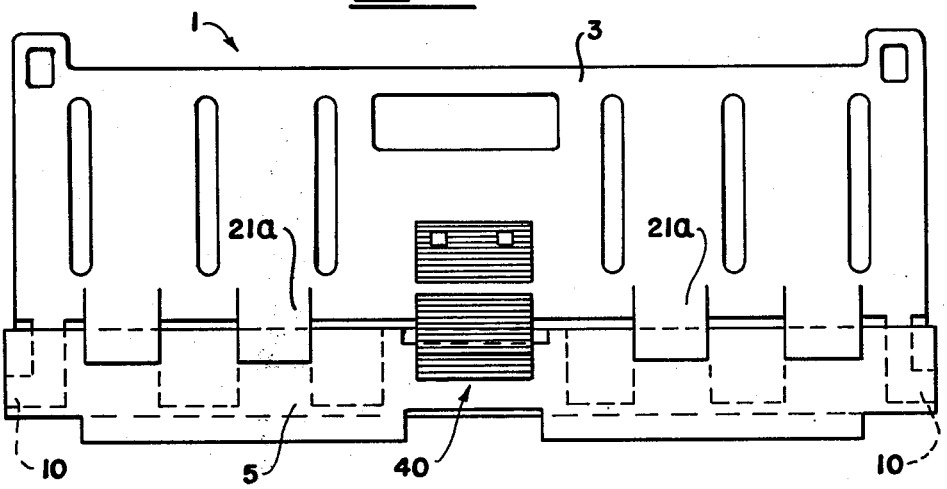
FIG. 2 is an end elevation of the carrier shown in FIG. 1.

The plastic carrier 1 shown in the drawings comprises a tray 2 having a pair of folding end walls 3.

More particularly, the tray 1 comprises a rectangular grid floor section 4 and a pair of stiff end rails 5 upstanding from the floor section. A second pair of side rails 7 may be included as part of the tray 1 to extend along the remaining pair of side edges, thereby providing lengthwise rigidity to the tray and enclosing the surface of the floor section 4.

Figure 3:
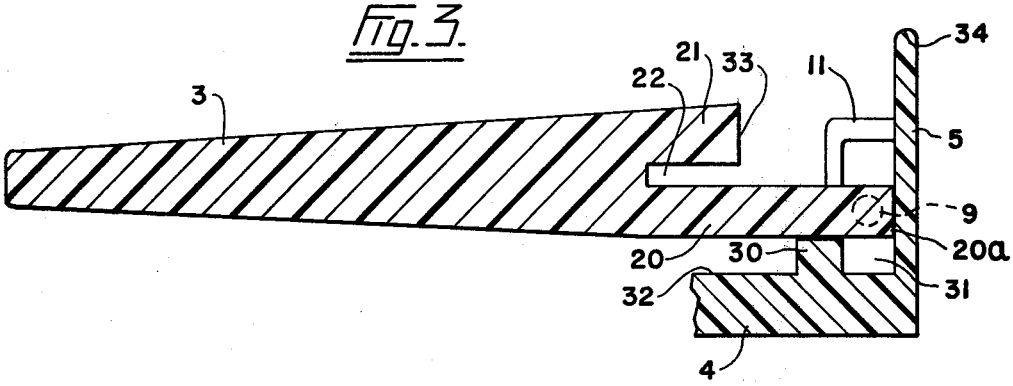
FIG. 3 is a section showing one of the end walls in the generally horizontal or folded position.
Figure 5:
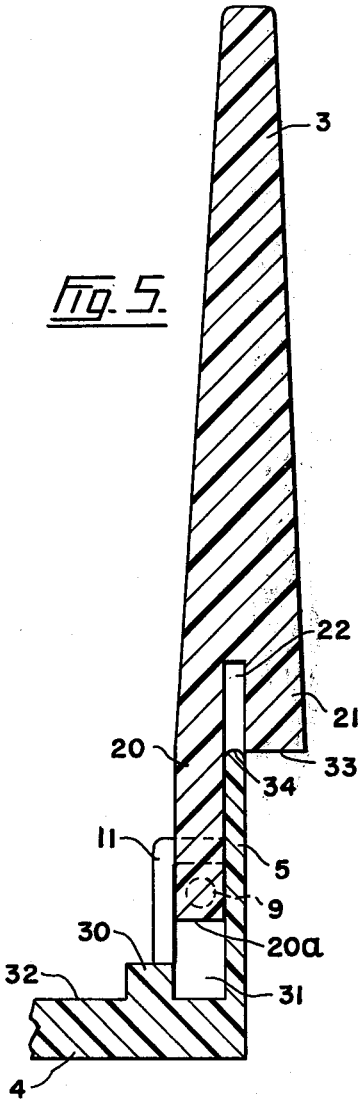
FIG. 5 is a section showing the end wall in a generally vertical and raised position.

The end walls 3 are pivotally connected with the tray 2 for rotation, from the generally horizontal position illustrated in FIG. 3, wherein they overlie the floor section 4, to the generally vertical position illustrated in FIG. 5, wherein they are disposed above the end rails 5. The pivot connection 9 is designed so that the end walls 3 may be shifted downwardly, when in the vertical position, onto the end rails 5 and may be raised back upwardly from the end rails 5 for a purpose described below. Thus the pivot connections 9 are adapted to permit the end walls 3 to both rotate about their lower side edges and to be moved up or down a short distance.

A suitable pivot connection 9 is shown in FIG. 1. It comprises laterally-directed pivot pins 10, one such pin being carried by each of the lower corners of the end walls 5, and sockets 11, formed on the side rails 7 adjacent each pin 10. Each pin 10 engages one of the sockets 11. The sockets 11 are elongate in a vertical direction, so that the pivot pins 10 may move vertically and pivot within them.

The lower edge portion of each end wall 3 comprises spaced-apart inner and outer leg portions 20, 21 which combine to define a first groove 22. Each groove 22 preferably extends the full length of the end wall which forms it and has a width corresponding to the thickness of the upper edge portion of the relevant end rail 5. The leg portions 20, 21 are of spaced rib construction and the inner leg ribs **20*a* preferably extend to a greater depth than the outer leg ribs 21*a***.

Integral with the floor section 4 and spaced a short distance from the base of each end rail 5 is a row of abutments 30. Each row of abutments 30 cooperates with the floor section 4 and adjacent end rail 5 to form a second groove 31. The width of the second groove 31 corresponds with the thickness of the inner leg ribs **20*a*, so as to receive them in snug engagement. Each abutment 30 is aligned opposite to an inner leg rib 20*a*** whereby they may engage.

Figure 4:
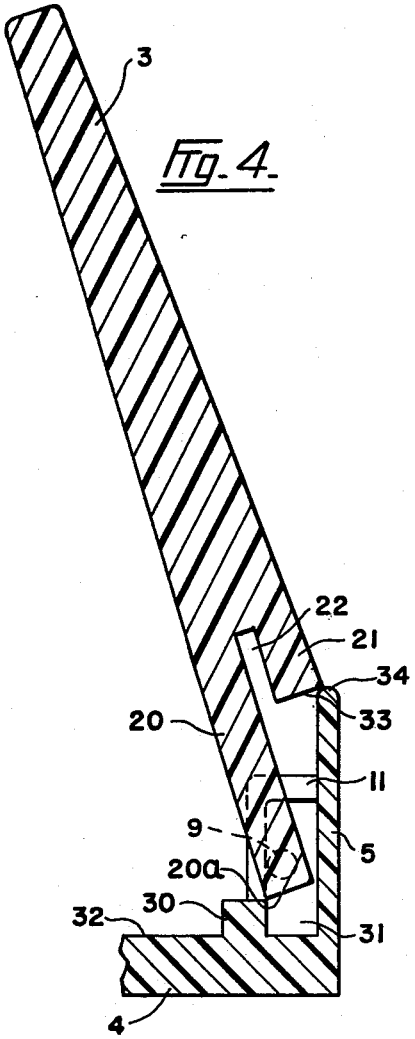
FIG. 4 is a section showing one of the end walls during movement from the generally horizontal position to a generally vertical position.

When each end wall 3 is rotated or pivoted from the horizontal position to the vertical position, the inner leg ribs **20*a* engage the adjacent abutments 30 (see FIG. 4). The latter maintain the end wall in an elevated condition relative to the floor section surface 32 until the bottom 33 of the outer leg ribs 21*a* engage the upper edge 34 of the adjacent end rail 5. The end wall 3 then rides up on the upper edge 34 until it has moved to the generally vertical position illustrated in FIG. 5. The upward movement of the end wall 3 during its rotation from the horizontal to the vertical is permitted by the vertical movement of the pivot pins 10 in the sockets 11**.

Figure 6:
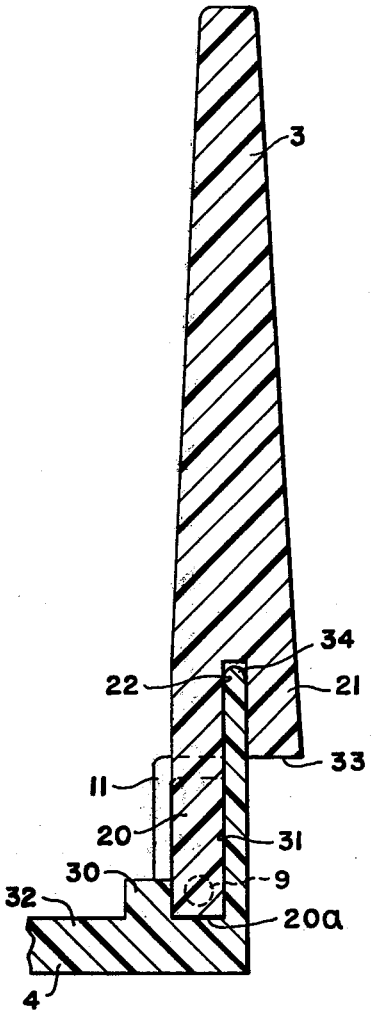
FIG. 6 is a section showing the end wall in a generally vertical and secured position.

When in the vertical position of FIG. 5, each end wall 3 may be shifted or displaced downward to the position showin in FIG. 6. When this occurs, the inner leg ribs **20*a* penetrate the second groove 31, with the result that the abutments 30 engage the ribs and restrain the end wall from rotating outward beyond vertical. At the same time, the end rail 5 seats in the first groove 22 and the outer leg ribs 21*a* cooperate with the rail to restrain the end wall from rotating back inwardly toward the floor section 4. The end wall 3 has thus been secured in a substantially vertical position and provides an upwardly projecting rigid extension of the end rail 5**.

The abutments 30 are preferably disposed along substantially the entire width of the floor section 4 at the base of each end rail 5 so that the resistance to rotation due to an outward force acting against the inside surface of the end wall 3 is distributed across the floor section 4. Likewise, the inner and outer leg portions 20, 21 of each side wall 3 are preferably disposed along substantially the entire width of the side wall so that resistance to rotation due to an inward force acting on the outside surface of the end wall is distributed along the associated end rail 5. In the embodiment illustrated, the interlocking system of grooves, abutments and leg portions are shown extending the full width of the floor section—however it is obvious that they could extend less than the full width.

Figure 7:
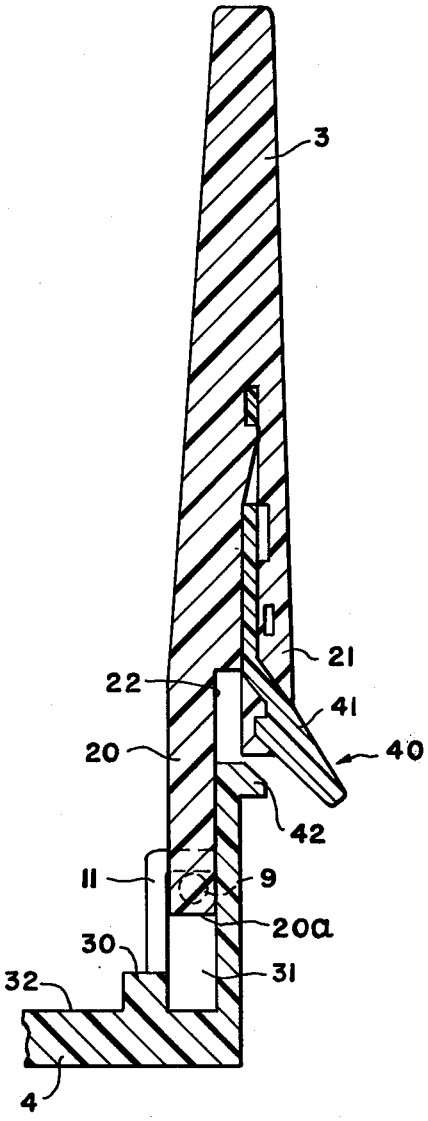
FIG. 7 is a section showing a securing element in the end wall.

Releasable means are provided for restraining upward movement of the end walls 3 relative to the tray 2 when the end walls are in the downwardly shifted position of FIG. 6. In one embodiment, shown in FIGS. 1 and 7, such means may comprise a flexible element 40 attached to each end wall 3. The element 40 has a lip 41 which will engage and lock beneath a member 42 projecting outwardly from the end rail 5. The lip 41 automatically engages the member 42 when the end wall 3 is displaced downwardly; to release the lip, the element 40 may be bent outwardly and the end wall can then be drawn upwardly.

Figure 8:
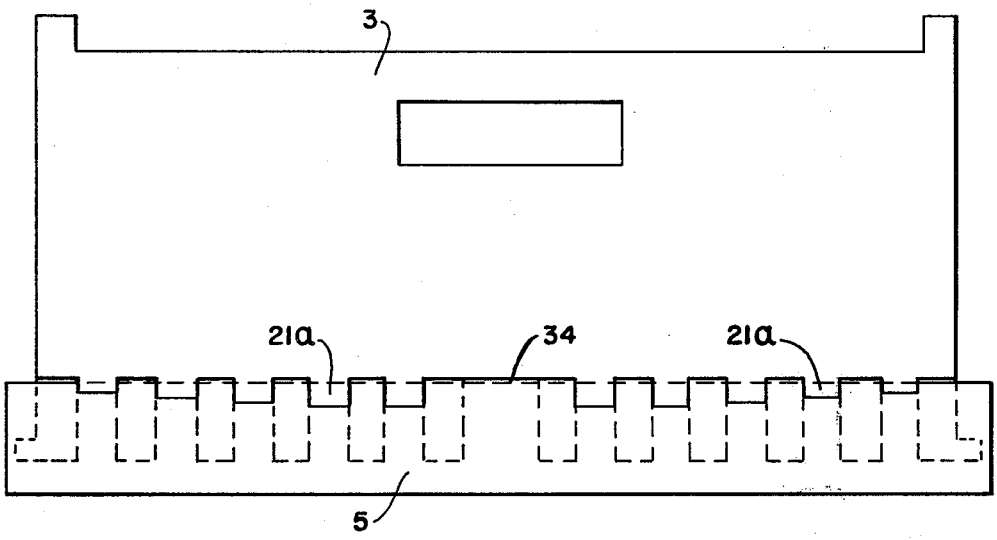
FIG. 8 is an end view of a carrier showing the bowing elements when the end wall is in the downwardly shifted position.
Figure 9:
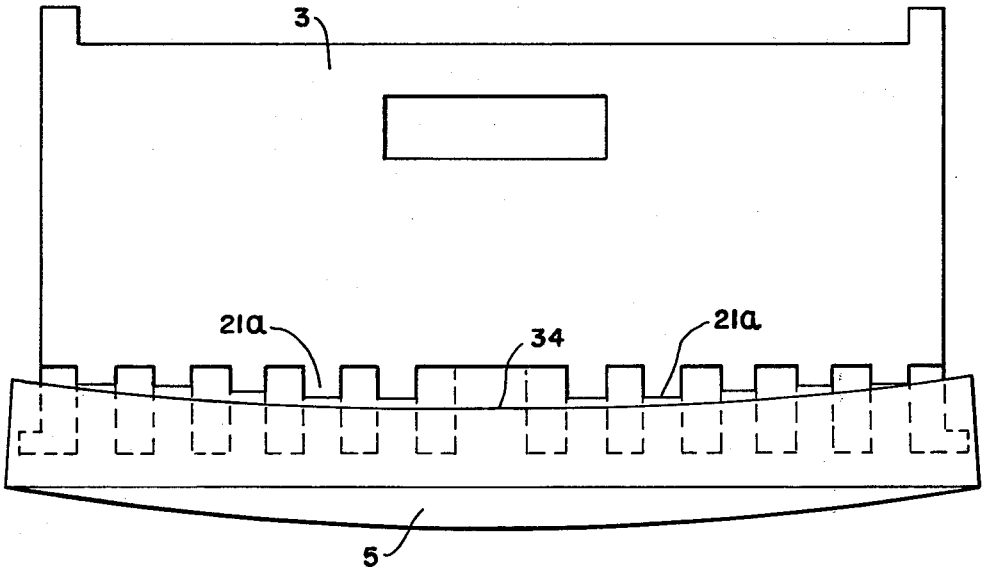
FIG. 9 is a view similar to that of FIG. 8, wherein the end wall is being rotated to vertical and the end rail is bowed.

An alternative embodiment of the releasable means is illustrated in FIGS. 8 and 9. As shown, the outer leg ribs **21*a* progressively increase in depth toward the midsection of the width of each end wall 3. Thus, as each end wall is rotated from the horizontal to the vertical, the midsection outer leg ribs 21*a* are the first to engage the upper edge 34 of the adjacent end rail 5, imposing an upward force against the midsection of the end wall and a downward force against the midsection of the end rail. Since the sockets 11 and pivot pins 10 are arranged so as to prevent further elevation of the end wall beyond a predetermined amount, the opposing forces at the midsections cause the end rail to bow downwards as the end wall is further rotated to the vertical position. Once the end wall 3 is in the vertical position, the end rail 5 automatically snaps into the first groove 22, relieving the bowing stresses on the end rail. The snapping action that occurs in the last step performs an automatic locking of the end wall with the end rail. To release this locking arrangement, the user pushes down on the floor section 4 and lifts upwardly on the end wall 3 to cause the end rail 5 to bow down sufficiently to allow outer leg ribs 21*a*** to pass inwardly over the upper edge of the rail.

Once the releasable means have been disengaged, the end wall 3 is free for rotation back down to the horizontal position.

While the present invention has been disclosed in connection with preferred embodiments thereof, it should be understood that there may be other embodiments which fall within the spirit and scope of the invention as defined by the following claims.

The embodiments of the invention in which an exclusive property or privilege is claimed are defined as follows:

1. A plastic carrier for bread and the like comprising:

a rectangular tray having a floor section and a pair of end rails upstanding from the floor section;

a pair of end walls connected with the tray for rotation, between a generally horizontal position overlying the floor section and a generally vertical position wherein they are disposed above the end rails, and for limited vertical movement, whereby the end walls may be shifted downward when generally vertical onto the end rails, to form upwardly projecting extensions of said end rails, or upward off the end rails;

each said end wall having a lower edge portion comprising spaced apart downwardly extending parallel inner and outer leg portions which form a first groove extending along at least the greatest part of said end wall's length, said first groove corresponding to the thickness of the upper edge portion of the adjacent end rail whereby, when the end wall is rotated to the generally vertical position and moved downward, the leg portions may drop down over and engage the upper edge portion of the end rail, to restrain the end wall from rotating back inward toward the floor section;

said floor section forming a second groove, disposed across the greatest part of its width adjacent the base of each end rail, for receiving the inner leg portion of the relevant end wall when the end wall has been rotated to the generally vertical position and moved downward to penetrate said second groove, a side wall of said second groove being operative to restrain the end wall from rotating further outward substantially beyond vertical; and releasable means for restraining upward movement of the end walls relative to the tray when said end walls are in the downwardly shifted position;

said releasable means comprising outer leg portions which are progressively longer toward the midsection of the end wall, whereby as each end wall is rotated upwardly, the midsection portion of the outer leg portion is first to engage the upper edge portion of the end rail, thereby causing the end rail to bow downwards as the end wall is further rotated to a generally vertical position, at which point the end rail automatically penetrates into the first groove.

2. A plastic carrier for bread and the like comprising:

a rectangular tray having a floor section and a pair of end rails upstanding from the floor section;

a pair of end walls connected with the tray for rotation, between a generally horizontal position overlying the floor section and a generally vertical position wherein they are disposed above the end rails, and for limited vertical movement, whereby the end walls may be shifted downward when generally vertical onto the end rails, to form upwardly projecting extensions of said end rails, or upward off the end rails;

each end wall having pivot pins at the lower corners thereof which are engaged in sockets formed at the corners of the tray, said sockets being elongate in a vertical direction to permit vertical movement of the pivot pins therein;

each end wall having a lower edge portion comprising spaced apart downwardly extending parallel inner and outer leg portions, the outer leg portions being lesser in length than the inner leg portions;

said inner and outer leg portions defining a first groove in the end walls of a width corresponding to the thickness of the upper portion of the associated end rail, whereby, when the end wall is rotated to the generally vertical position and moved downward, the leg portions may drop down over and engage the upper edge portion of the end rail, to restrain the end wall from rotating back inwardly toward the floor section;

said inner and outer leg portions of the end walls being disposed along the greatest part of the width of the floor section;

said floor section having abutment means extending along each end rail and spaced from the end rail by a distance corresponding to the thickness of the inner leg portion of the associated end wall, to define a second groove into which the inner leg penetrates whereby, when the inner leg portion of the end wall is engaged by the abutment means and the end rail, the end wall is restrained from rotating further outward substantially beyond the vertical;

said abutment means being disposed along substantially the entire width of the floor section;

said inner leg portions of the end wall engaging the associated abutment means as the end wall is moved from the generally horizontal position, said inner leg portion and abutment means cooperating to lift the end wall to a position wherein the lower edge portion of the outer leg portion interacts with the upper edge portion of the associated end rail to further lift the end wall to a substantially vertical position wherein the end wall may be shifted downward to engage the lower edge portion of the inner leg portion within the second groove; and releasable means for restraining upward movement of the end walls relative to the tray when said end walls are in the downwardly shifted position;

said releasable means comprising outer leg portions which are progressively longer toward the midsection of the end wall, whereby as each end wall is rotated upwardly, the midsection portion of the outer leg portion is first to engage the upper edge portion of the end rail, thereby causing the end rail to bow downwards as the end wall is further rotated to a generally vertical position, at which point the end rail automatically penetrates into the first groove.

* * * * *